US012274912B2

(12) United States Patent
Aoki

(10) Patent No.: US 12,274,912 B2
(45) Date of Patent: Apr. 15, 2025

(54) FOOT-PEDALING EXERCISE SYSTEM, CONTROL METHOD, AND PROGRAM

(71) Applicant: TOYOTA JIDOSHA KABUSHIKI KAISHA, Toyota (JP)

(72) Inventor: Eisuke Aoki, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 185 days.

(21) Appl. No.: 18/170,099

(22) Filed: Feb. 16, 2023

(65) Prior Publication Data

US 2023/0330477 A1 Oct. 19, 2023

(30) Foreign Application Priority Data

Apr. 15, 2022 (JP) ..... 2022-067516

(51) Int. Cl.
*A63B 22/06* (2006.01)
*A63B 21/00* (2006.01)

(52) U.S. Cl.
CPC ..... *A63B 22/0694* (2013.01); *A63B 21/4034* (2015.10)

(58) Field of Classification Search
CPC ..... A63B 22/0694
See application file for complete search history.

(56) References Cited

U.S. PATENT DOCUMENTS 5,807,212 A * 9/1998 Nelson ..... A63B 21/1609 482/904
5,860,941 A * 1/1999 Saringer ..... A63B 22/0605 601/36
6,179,746 B1 * 1/2001 Delman ..... A63B 71/0622 482/902
9,757,611 B1 * 9/2017 Colburn ..... A63B 21/0051
10,173,094 B2 * 1/2019 Gomberg ..... A63B 69/16
11,471,729 B2 * 10/2022 Hacking ..... A63B 22/0605
2013/0169016 A1 * 7/2013 Meyuhas ..... A47C 1/02 297/313
2014/0256512 A1 * 9/2014 Kaiser ..... G16H 20/30 482/9
2017/0021230 A1 * 1/2017 Osler ..... A63B 26/003
2019/0358483 A1 * 11/2019 Fuchs ..... B62M 19/00
2020/0016453 A1 * 1/2020 Kollreider ..... A63B 24/0087
2021/0138304 A1 * 5/2021 Mason ..... A63B 24/0075
2022/0118309 A1 * 4/2022 Aoki ..... A63B 21/4034
2022/0288460 A1 * 9/2022 Mason ..... G16H 50/70
2024/0001215 A1 * 1/2024 Nakashima ..... A63B 71/0622
2024/0050801 A1 * 2/2024 Hull ..... A63B 24/0062

FOREIGN PATENT DOCUMENTS

JP 2009-077828 A 4/2009
JP 2015-204873 A 11/2015
JP 2018-171421 A 11/2018

* cited by examiner

*Primary Examiner* — Joshua T Kennedy
(74) *Attorney, Agent, or Firm* — Oliff PLC

(57) ABSTRACT

A foot-pedaling exercise system assists workers, the foot-pedaling exercise system including an integrated pedal unit, rotatably supported by an equipment main body. The system includes a sitting part that performs yaw and roll turns through a turn actuator. When an exercise monitoring sensor detects inactivity, the controller initiates control to create a kinematic chain that encourages natural exercise motions of the user.

8 Claims, 8 Drawing Sheets

FOOT-PEDALING EXERCISE SYSTEM, CONTROL METHOD, AND PROGRAM

CROSS REFERENCE TO RELATED APPLICATIONS

This application is based upon and claims the benefit of priority from Japanese patent application No. 2022-067516, filed on Apr. 15, 2022, the disclosure of which is incorporated herein in its entirety by reference.

BACKGROUND

The present disclosure relates to a foot-pedaling exercise system, a control method, and a program.

Patent document 1 (Japanese Unexamined Patent Application Publication No. 2018-171421) discloses a foot-pedaling exercise equipment equipped with an electric assist function. This foot-pedaling exercise equipment can be used by people with functional impairment in their lower limb nerves due to stroke or other illnesses, or by those who have excessively weakened leg muscles due to aging.

SUMMARY

By the way, it is generally preferable to install a foot-pedaling exercise equipment under a desk to eliminate the lack of daily exercise associated with desk work. That is, if a user uses the foot-pedaling exercise equipment to perform the foot-pedaling exercise in a seated position at his/her desk while working, it is possible to eliminate the lack of daily exercise without having to set aside time for exercise.

However, simply installing a foot-pedaling exercise equipment under a desk does not mean that everyone performs the foot-pedaling exercise. This is because there are individual differences in the motivation for the foot-pedaling exercise. That is, it is quite difficult for those with low motivation for the foot-pedaling exercise to actually start the foot-pedaling exercise.

In view of the above discussion, an object of this disclosure is to provide a technique for helping a user to start a foot-pedaling exercise when he/she performs the foot-pedaling exercise.

According to a first aspect of the present disclosure, a foot-pedaling exercise system including: a pedal unit including a pair of pedals; an equipment main body configured to rotatably support the pedal unit; a rotary actuator configured to rotate the pedal unit; an exercise monitoring sensor configured to detect the performance or the non-performance of a foot-pedaling exercise performed using the pedal unit; and a controller, in which the controller controls, when it has been determined that the foot-pedaling exercise is not being performed based on the result of the detection in the exercise monitoring sensor, the rotary actuator to cause the rotary actuator to rotate the pedal unit is provided. According to the above configuration, if the user does not perform the foot-pedaling exercise, the above pedal unit automatically starts to rotate, so that it is possible to help the user to start the foot-pedaling exercise.

The controller may control, when it has been determined that a state in which the foot-pedaling exercise is not being performed has continued for a first period of time or longer based on the result of the detection in the exercise monitoring sensor, the rotary actuator to cause the rotary actuator to rotate the pedal unit. According to the above configuration, it is possible to secure time for the user to rest without forcing the user to perform the foot-pedaling exercise at all times.

The controller may stop, when a predetermined condition has been satisfied after the control by which the rotary actuator rotates the pedal unit has been started, the control by which the rotary actuator rotates the pedal unit. According to the above configuration, it is possible to help the user to start the foot-pedaling exercise until a predetermined condition is satisfied.

The predetermined condition may be in which a second period of time passes after the controller has started the control by which the rotary actuator rotates the pedal unit. According to the above configuration, it is possible to help the user to start the foot-pedaling exercise until the second period of time passes.

The exercise monitoring sensor may be a motion detection sensor configured to detect a motion of a lower limb of a user.

The exercise monitoring sensor may be a rotation detection sensor configured to detect rotation of the pedal unit.

The foot-pedaling exercise system may further include a sitting part on which a user who performs the foot-pedaling exercise can sit, in which the sitting part is configured to be able to swing with a three-axis degree of freedom. According to the above configuration, when the pedal unit starts to automatically rotate, the trunk muscles can be trained by an ascending kinetic chain.

According to a second aspect of the present disclosure, a control method of a foot-pedaling exercise system including: a pedal unit including a pair of pedals; an equipment main body configured to rotatably support the pedal unit; a rotary actuator configured to rotate the pedal unit; and an exercise monitoring sensor configured to detect the performance or the non-performance of a foot-pedaling exercise performed using the pedal unit, the control method including: determining whether the foot-pedaling exercise is being performed based on the result of the detection in the exercise monitoring sensor; and controlling, when it has been determined that the foot-pedaling exercise is not being performed, the rotary actuator to cause the rotary actuator to rotate the pedal unit is provided. According to the above method, if the user does not perform the foot-pedaling exercise, the pedal unit automatically starts to rotate, so that it is possible to help the user to start the foot-pedaling exercise.

A program for causing a computer to execute the above control method is provided.

According to a third aspect of the present disclosure, a foot-pedaling exercise system including: a pedal unit including a pair of pedals; an equipment main body configured to rotatably support the pedal unit; a sitting part configured to be able to carry out a yaw turn or a roll turn; a turn actuator configured to yaw turn or roll turn the sitting part; an exercise monitoring sensor configured to detect the performance or the non-performance of a foot-pedaling exercise performed using the pedal unit; and a controller, in which the controller controls, when it has been determined that the foot-pedaling exercise is not being performed based on the result of the detection in the exercise monitoring sensor, the turn actuator to cause the turn actuator to yaw turn or roll turn the sitting part is provided. According to the above configuration, since the sitting part automatically starts to carry out a yaw turn or a roll turn when the user does not perform the foot-pedaling exercise, a descending kinetic chain between the pelvis and the lower limb can help the user to start the foot-pedaling exercise.

The controller may control, when it is determined that a state in which the foot-pedaling exercise is not being performed continues for a third period of time or longer based on the result of the detection in the exercise monitoring sensor, the turn actuator to cause the turn actuator to yaw turn or roll turn the sitting part. According to the above configuration, it is possible to secure time for the user to rest without forcing the user to perform the foot-pedaling exercise at all times.

The controller may stop, when a predetermined condition has been satisfied after the control by which the turn actuator yaw turns or roll turns the sitting part has been started, the control by which the turn actuator yaw turns or roll turns the sitting part. According to the above configuration, it is possible to help the user to start the foot-pedaling exercise until a predetermined condition is satisfied.

The predetermined condition may be in which a fourth period of time passes after the control by which the turn actuator yaw turns or roll turns the sitting part has been started. According to the above configuration, it is possible to help the user to start the foot-pedaling exercise until the fourth period of time passes.

The exercise monitoring sensor may be a motion detection sensor configured to detect a motion of a lower limb of a user.

The exercise monitoring sensor may be a rotation detection sensor configured to detect rotation of the pedal unit.

According to a fourth aspect of the present disclosure, a control method of a foot-pedaling exercise system including: a pedal unit including a pair of pedals; an equipment main body configured to rotatably support the pedal unit; a sitting part configured to be able to carry out a yaw turn or a roll turn; a turn actuator configured to yaw turn or roll turn the sitting part; and an exercise monitoring sensor configured to detect the performance or the non-performance of a foot-pedaling exercise performed using the pedal unit, the control method including: determining whether the foot-pedaling exercise is being performed based on the result of the detection in the exercise monitoring sensor; and controlling, when it has been determined that the foot-pedaling exercise is not being performed, the turn actuator to cause the turn actuator to yaw turn or roll turn the sitting part is provided. According to the above method, since the sitting part automatically starts to carry out a yaw turn or a roll turn when the user does not perform the foot-pedaling exercise, a descending kinetic chain between the pelvis and the lower limb can help the user to start the foot-pedaling exercise.

A program for causing a computer to execute the above control method is provided.

According to the present disclosure, it is possible to help a user to start a foot-pedaling exercise when he/she performs the foot-pedaling exercise.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

First Embodiment

Figure 1:
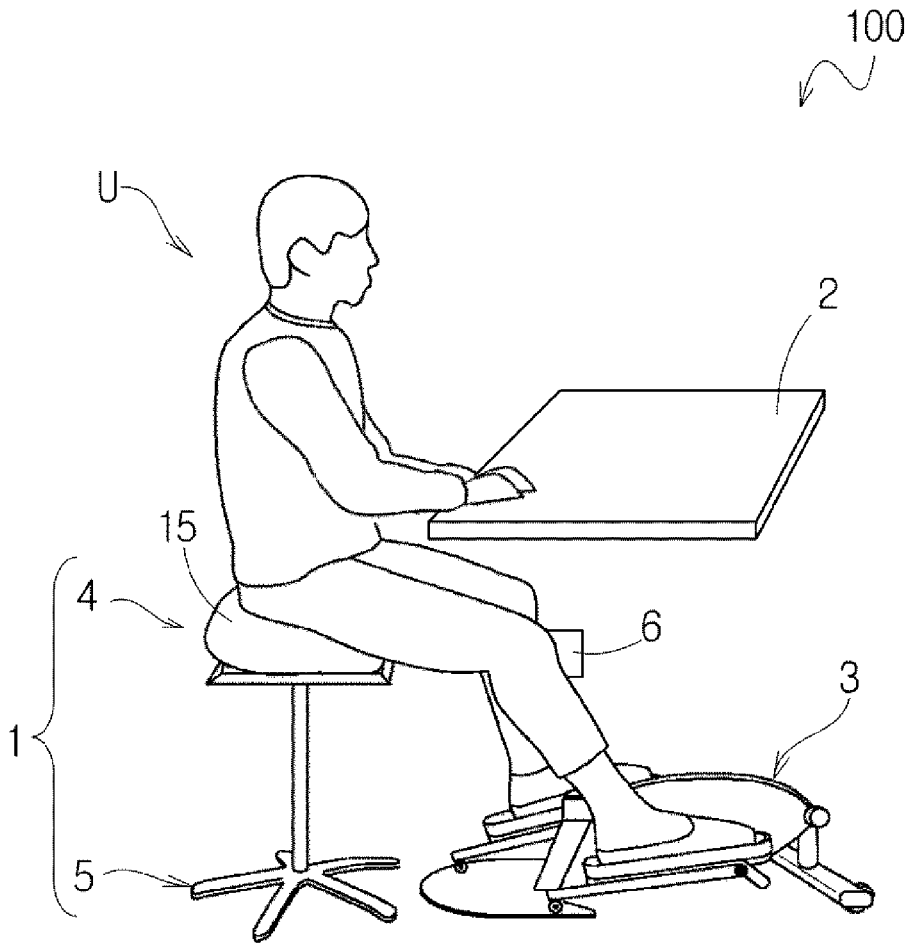
FIG. 1 is a side view of a foot-pedaling exercise system (first embodiment)

A first embodiment of this disclosure will be described below with reference to FIGS. 1 to 5. FIG. 1 shows a foot-pedaling exercise system 100.

FIG. 1 shows a user U seated on a chair 1 doing desk work using a laptop computer (not shown) placed on a desk 2. A foot-pedaling exercise equipment 3 is placed under the desk 2. The user U can perform a foot-pedaling exercise using the foot-pedaling exercise equipment 3 during the desk work.

The chair 1 includes a turning apparatus 4 and a support part 5 supporting the turning apparatus 4. An infrared sensor 6 (exercise monitoring sensor) that detects the performance or the non-performance of the foot-pedaling exercise by the user U is provided on the side of the lower limb of the user U.

Figure 2:
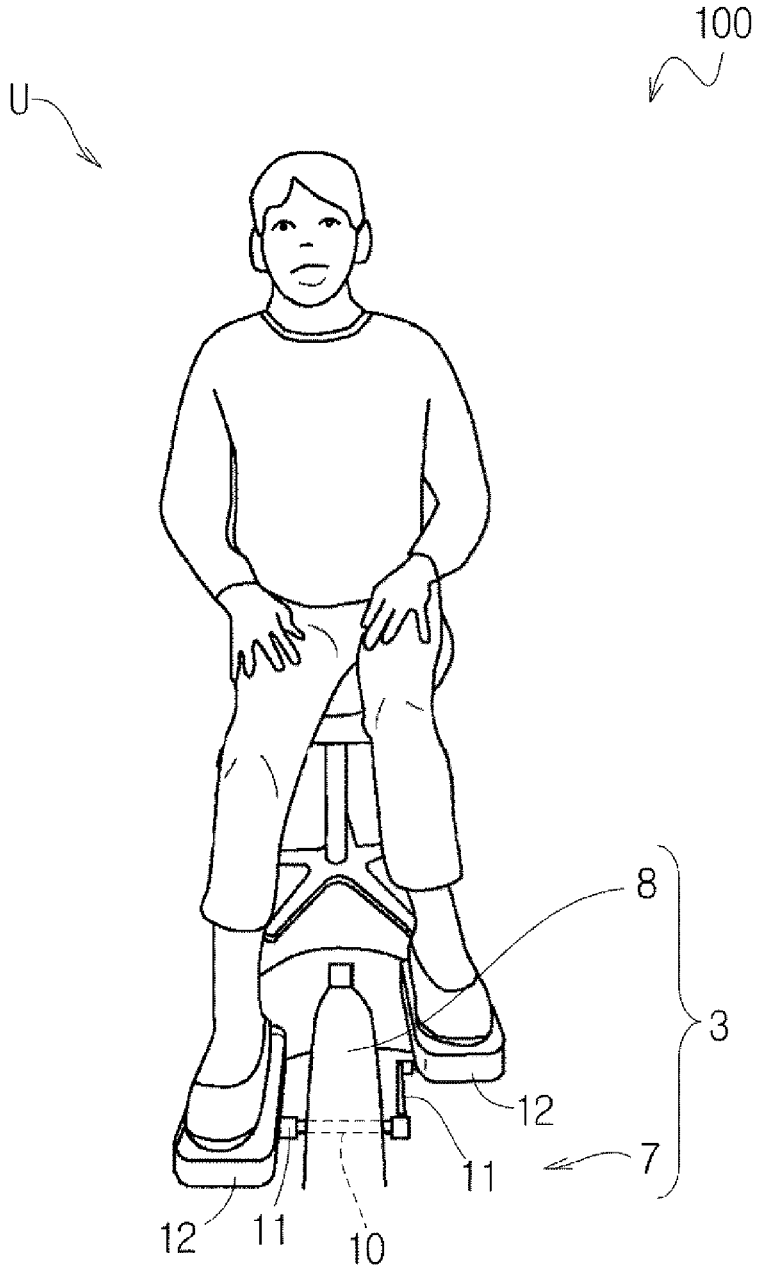
FIG. 2 is a front view of the foot-pedaling exercise system (first embodiment)

FIG. 2 shows the user U performing the foot-pedaling exercise with the foot-pedaling exercise equipment 3. As shown in FIG. 2, the foot-pedaling exercise equipment 3 includes a pedal unit 7 and an equipment main body 8.

The pedal unit 7 includes a shaft 10 rotatably supported by the equipment main body 8, a pair of cranks 11 coupled to the shaft 10, and a pair of pedals 12 rotatably attached to the pair of respective cranks 11. The user U performs the foot-pedaling exercise by stepping forward with both feet alternately while placing the feet on the pair of respective pedals 12.

Figure 3:
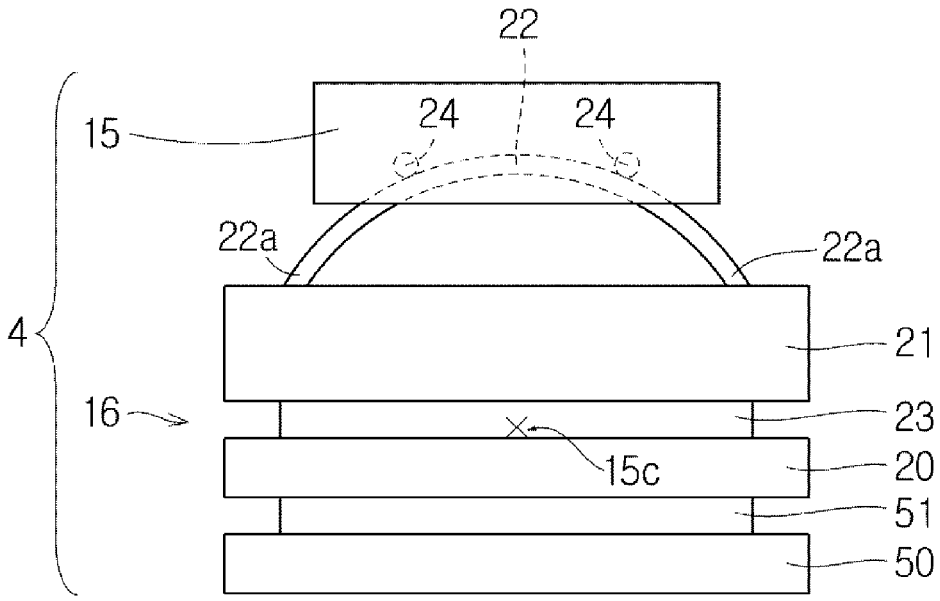
FIG. 3 is a front view of a turning apparatus (first embodiment)

FIG. 3 shows a front view of the turning apparatus 4. That is, FIG. 3 shows the view of the turning apparatus 4 in the direction perpendicular to the coronal plane. As shown in FIG. 3, the turning apparatus 4 includes a sitting part and an apparatus main body 16.

The sitting part 15 is configured to allow the user U to sit thereon. The sitting part 15 is a part that is in surface contact with the user U in the vertical direction.

The apparatus main body 16 supports the sitting part 15 in such a way that the sitting part 15 can carry out a yaw turn, a roll turn, and a pitch turn. That is, the apparatus main body 16 supports the sitting part 15 in such a way that the sitting part 15 has a three-axis degree of freedom. The apparatus main body 16 supports the sitting part 15 in such a way that the sitting part 15 can swing about three axes. The apparatus main body 16 may support the sitting part 15 in such a way that the sitting part 15 can carry out only one of the yaw turn, the roll turn, and the pitch turn. The apparatus main body 16 may support the sitting part 15 in such a way that the sitting part 15 can carry out only two of the yaw turn, the roll turn, and the pitch turn. The apparatus main body 16 may support the sitting part in such a way that the sitting part 15 can carry out the yaw turn and the roll turn. A desired configuration may be employed as a configuration in which the apparatus main body 16 supports the sitting part 15 in such a way that the sitting part 15 can carry out the yaw turn, the roll turn, and the pitch turn. Specific examples of the apparatus main body 16 will be described below, but they are not limited to the following specific examples.

As one specific example, the apparatus main body 16 includes a coupling base 50, a coil spring 51, a lower base 20, an upper base 21, an arched rail 22, and a thrust bearing 23.

The coupling base 50 is fixed to the support part 5 of the chair 1 as shown in FIG. 1. The lower base 20 is mounted on the coupling base 50 via the coil spring 51. The coil spring 51 is a compression coil spring. The pitch direction of the coil spring 51 coincides with the vertical direction. Thus, the lower base 20 is configured to be able to carry out a pitch turn and a roll turn relative to the coupling base 50. The upper base 21 is mounted on the lower base 20 via the thrust bearing 23. Thus, the upper base 21 is configured to be able to carry out a yaw turn relative to the lower base 20. The arched rail 22, with its upwardly convex arch, is mounted on the upper base 21. The sitting part 15 includes two wheels 24. The two wheels 24 roll along the arched rail 22. This allows the sitting part 15 to move along the arched rail 22. In other words, the sitting part 15 is configured to be able to carry out a roll turn. The sitting part 15 descends as it moves from a center 22*c* of the arched rail 22 in the longitudinal direction to end parts 22*a* of the arched rail 22 in the longitudinal direction. Therefore, a roll axis 15*c* in the roll turn of the sitting part 15 using arched rail 22 is set to be lower than the sitting part 15. This makes the sitting part 15 difficult to stay in the center 22*c* of the arched rail 22 and the sitting part 15 thus has unstable properties. The turning apparatus 4 may be provided with the coil spring along the arched rail 22. The coil spring pushes the sitting part 15 back toward the center 22*c* of the arched rail 22. This could alleviate the unstable properties of the sitting part 15.

Returning to FIG. 1, the infrared sensor 6 is a specific example of the exercise monitoring sensor, positioned on the side of the lower limb of the user U, and detects the performance or the non-performance of the foot-pedaling exercise by the user U. That is, the infrared sensor 6 detects whether there is a movement of the lower limb of the user U. The infrared sensor 6 is configured to output a detection signal to the foot-pedaling exercise equipment 3.

Figure 4:
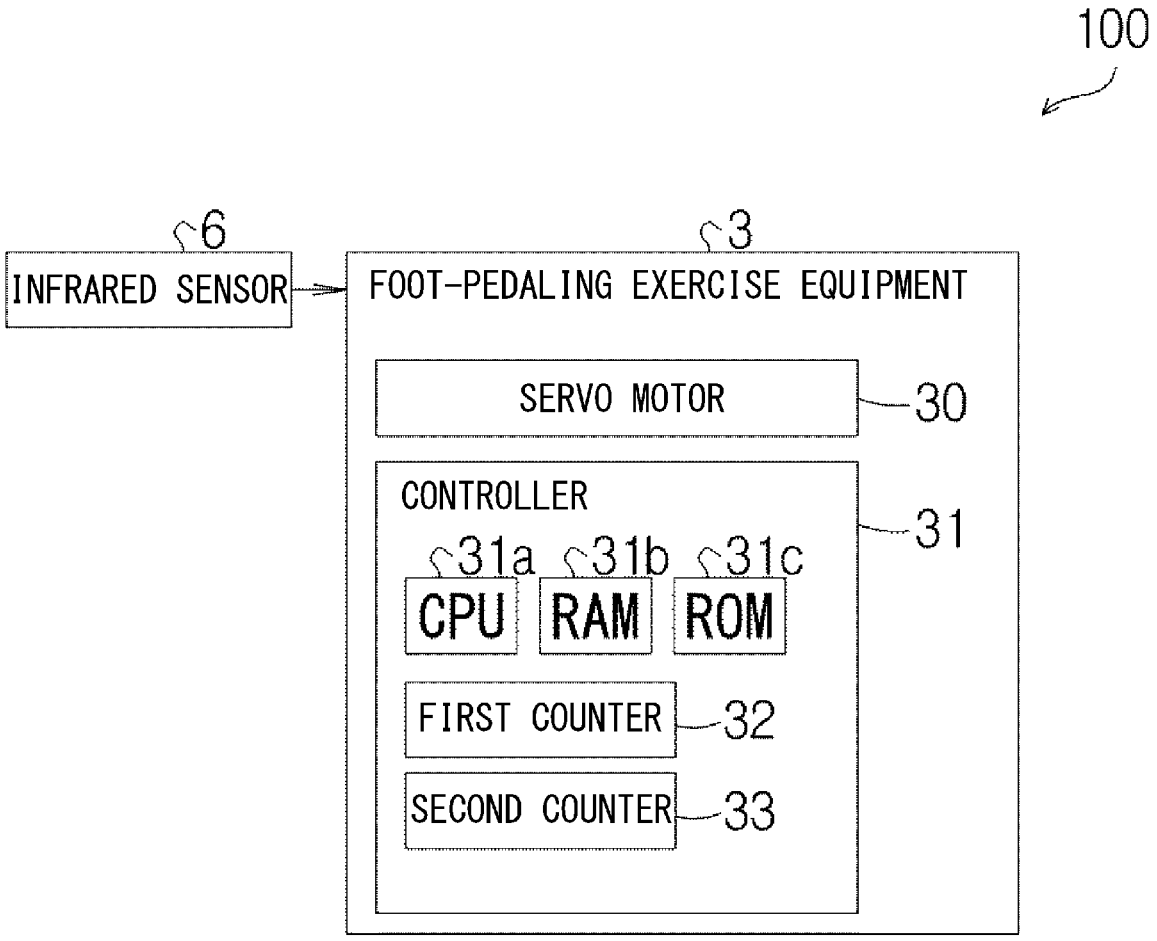
FIG. 4 is a functional block diagram of the foot-pedaling exercise system (first embodiment)

FIG. 4 shows a functional block diagram of the foot-pedaling exercise system 100. As shown in FIG. 4, the foot-pedaling exercise equipment 3 includes a servomotor 30 and a controller 31. The servomotor 30 is a specific example of a rotary actuator and a load actuator.

In this embodiment, the servomotor 30 is a servomotor with an electromagnetic brake. The output axis of the servomotor 30 is coupled to the shaft 10 of the foot-pedaling exercise equipment 3 shown in FIG. 2 via a reduction mechanism (not shown). Thus, the servomotor 30 functions as a rotary actuator that rotates the pedal unit 7. Similarly, according to this configuration, the servomotor 30 also functions as a load actuator that applies a load to the rotation of the pedal unit 7.

The controller 31 controls the servomotor 30. The controller 31 is equipped with a Central Processing Unit (CPU) 31*a*, a readable/writable Random Access Memory (RAM) 31*b*, and a Read Only Memory (ROM) 31*c*. Then, the CPU 31*a* loads the control program stored in the ROM 31*c* to execute the loaded control program, whereby the control program makes the hardware such as the CPU 31*a* function as the controller 31.

The controller 31 is equipped with a first counter 32 and a second counter 33. Both the first counter 32 and the second counter 33 are counters for counting time.

In this embodiment, the foot-pedaling exercise system 100 includes at least the pedal unit 7, the equipment main body 8, the servomotor 30 as the rotary actuator, the infrared sensor 6 as the exercise monitoring sensor, and the controller 31. The foot-pedaling exercise system 100 may further include the chair 1, the foot-pedaling exercise equipment 3, and the infrared sensor 6.

Figure 5:
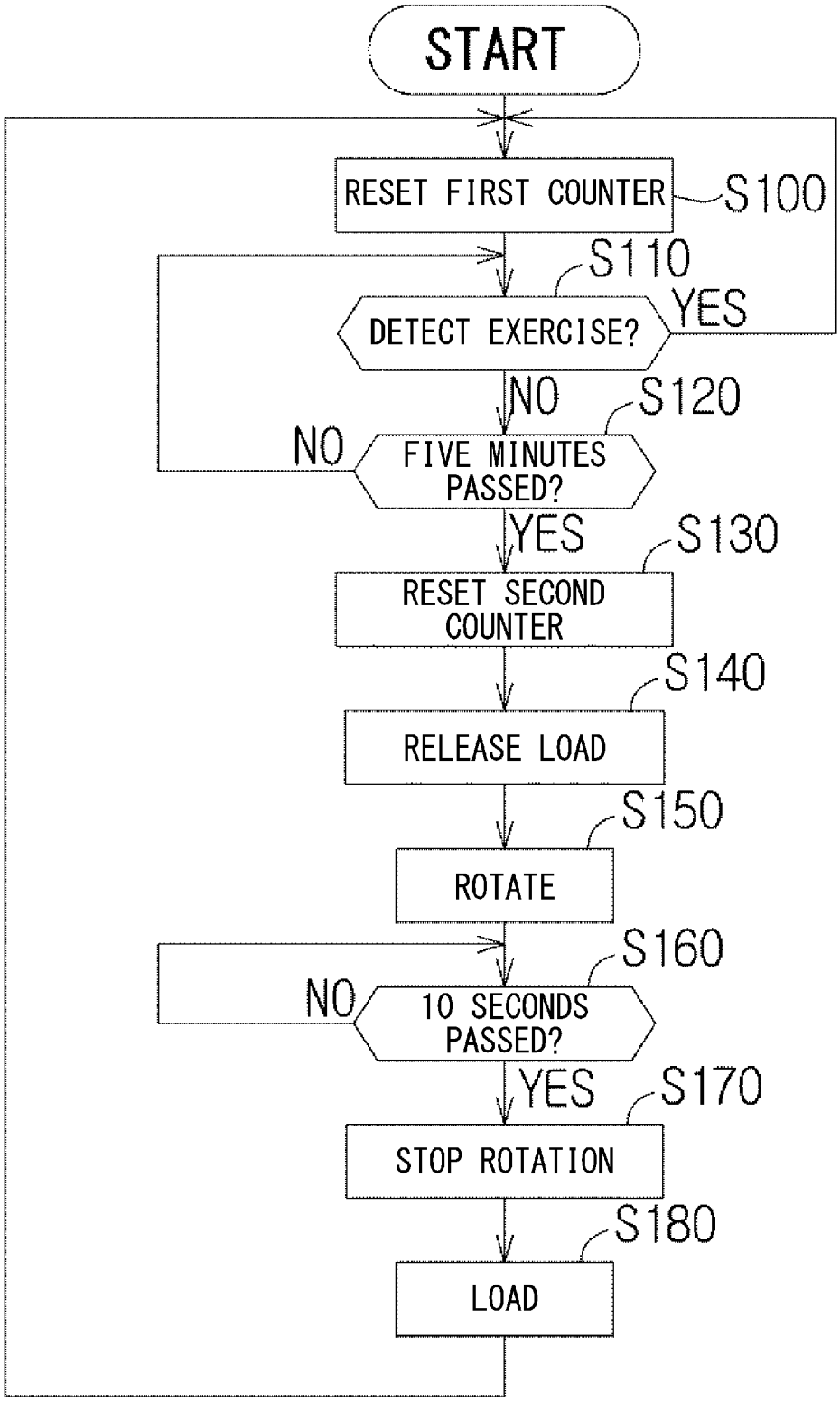
FIG. 5 is a control flow of the foot-pedaling exercise system (first embodiment)

Next, the operation of the foot-pedaling exercise system 100 will be described with reference to FIG. 5.

S100:

First, the controller 31 resets the first counter 32.

S110:

Next, the controller 31 detects the performance or the non-performance of the foot-pedaling exercise by the user U based on the detection signal received from the infrared sensor 6. If YES in S110, the controller 31 returns the processing to S100. On the other hand, if NO in S110, the controller 31 advances the processing to S120.

S120:

Next, the controller 31 determines whether the first counter 32 has counted five minutes. If NO in S120, the controller 31 returns the processing to S110. On the other hand, if YES in S120, the controller 31 advances the processing to S130.

S130:

The controller 31 then resets the second counter 33.

S140:

The controller 31 then releases the load applied to the rotation of the pedal unit 7 by the servomotor 30.

S150:

The controller 31 then controls the servomotor 30 in such a way that the servomotor 30 rotates the pedal unit 7 at a predetermined speed. This will start the foot-pedaling exercise by the user U regardless of whether the user U wants to start the foot-pedaling exercise.

S160:

The controller 31 then waits until the second counter 33 counts 10 seconds.

S170:

The controller 31 then stops the control of the servomotor 30 where the servomotor 30 rotates the pedal unit 7 at the predetermined speed. It is the user U who decides whether the pedal unit 7 will rotate after the stop of the control. It can be said that once the user U starts the foot-pedaling exercise even if this exercise is passively started, it is easy for the user U to voluntarily perform the foot-pedaling exercise even after the control of the servomotor 30 stops.

S180:

The controller 31 then controls the servomotor 30 so that the servomotor applies a load to the rotation of the pedal unit 7. The controller 31 then returns the processing to S100.

Although the first embodiment has been described above, the above embodiment has the following features.

The foot-pedaling exercise system 100 includes the pedal unit 7 including the pair of pedals 12, the equipment main body 8 rotatably supporting the pedal unit 7, the servomotor 30 as the rotary actuator rotating the pedal unit 7, the infrared sensor 6 as the exercise monitoring sensor detecting the performance or the non-performance of the foot-pedaling exercise using the pedal unit 7, and the controller 31. When the controller 31 determines that the foot-pedaling exercise has not been performed based on the detection result of the infrared sensor 6, the controller 31 controls the servomotor 30 so that the servomotor 30 rotates the pedal unit 7. According to the above configuration, if the user U does not perform the foot-pedaling exercise, the pedal unit 7 automatically starts to rotate, whereby it is possible to help the user U to start the foot-pedaling exercise.

When the controller 31 determines, based on the detection result of the infrared sensor 6, that a state in which foot-pedaling exercise is not performed has continued for five minutes (a first period of time) or longer (S120: YES), the controller 31 controls the servomotor 30 so that the servomotor 30 rotates the pedal unit 7. According to the above configuration, it is possible to secure time for the user U to rest without encouraging the user to start the foot-pedaling exercise at all times.

When a predetermined condition has been satisfied after the control by which the servomotor 30 rotates the pedal unit 7 has been started, the controller 31 stops the control by which the servomotor 30 rotates the pedal unit 7. According to the above configuration, it is possible to help the user U to start the foot-pedaling exercise until the predetermined condition is satisfied.

The predetermined condition is in which 10 seconds (a second period of time) pass after the servomotor 30 starts the control of rotating the pedal unit 7. According to the above configuration, it is possible to help the user U to start the foot-pedaling exercise until 10 seconds pass. Note that the second period of time is generally set shorter than the first period of time.

The foot-pedaling exercise system 100 further includes the sitting part 15 on which the user U who performs the foot-pedaling exercise can sit. The sitting part 15 is configured to be able to swing with a three-axis degree of freedom. According to the above configuration, when the pedal unit 7 starts to automatically rotate by the servomotor 30, the trunk muscles of the user U can be trained by the ascending kinetic chain.

Further, in the control of the foot-pedaling exercise system 100, it is determined whether the foot-pedaling exercise is being performed based on the detection result of the infrared sensor 6 (S110). When it is determined that the foot-pedaling exercise is not being performed (S110: NO), the servomotor 30 is controlled in such a way that the servomotor 30 rotates the pedal unit 7. According to the above method, if the user U does not perform the foot-pedaling exercise, the pedal unit 7 will automatically start rotating, whereby it is possible to help the user U to start the foot-pedaling exercise.

Also, in the above embodiment, the sitting part 15 is configured to be able to carry out a yaw turn and a roll turn. By using this sitting part 15, the kinematic chain between the lower limb and the trunk can be established during the foot-pedaling exercise, and the trunk muscles such as rectus abdominis, transversus abdominis and erector spinae can be exercised simultaneously while performing the foot-pedaling exercise in a sitting position. Also, by deliberately destabilizing the sitting part 15 as described above, the kinetic chain between the lower limb and the trunk is exerted more effectively. And if the exercise of the trunk muscles is achieved as described above, first, it can be expected that the size of the waist will be reduced. Second, it will strengthen the rectus abdominis, transversus abdominis, and erector spinae muscles, whereby it will become easier to maintain a forward-leaning posture of the pelvis, which will also help eliminate hunchbacks and straight necks. In addition, if the kinematic chain between the lower limb and the trunk can be achieved as described above, the pelvis can be moved intensively, which mainly increases the flexibility of the iliopsoas muscle, and chronic low back pain may be reduced.

In the above embodiment, the rotation of the pedal unit 7 by the servomotor 30 stops at a predetermined time (S170), and thereafter, a load is applied to the rotation of the pedal unit 7 by the servomotor 30 (S180). Therefore, when the user U starts to perform the foot-pedaling exercise voluntarily and actively on his/her own volition, the exercise effects represented by the calorie consumption by aerobic exercise and the strengthening of muscles of the lower limb and the trunk will be obtained. However, Step S140 may be omitted and a constant load may be applied to the rotation of the pedal unit 7 by the servomotor 30.

Second Embodiment

Next, a second embodiment will be described with reference to FIGS. 6 to 8. Hereafter, the differences from the above first embodiment will be mainly explained, and overlapping explanations will be omitted.

Figure 6:
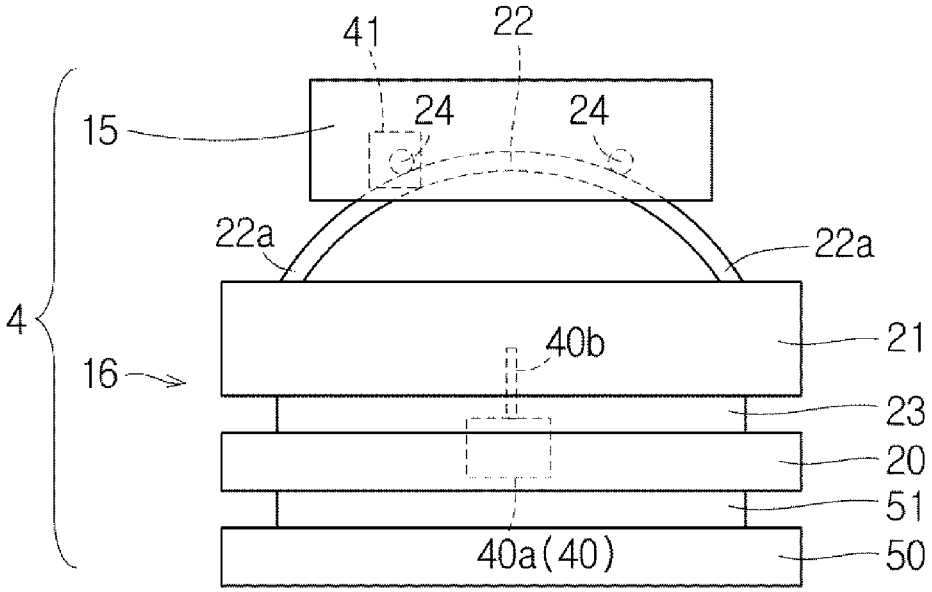
FIG. 6 is a front view of a turning apparatus (second embodiment)

FIG. 6 shows a front view of the turning apparatus 4. That is, FIG. 6 shows the view of the turning apparatus 4 in the direction perpendicular to the coronal plane.

In this embodiment, the turning apparatus 4 further includes a yaw turn servomotor 40 and a roll turn servomotor 41.

The yaw turn servomotor 40 is a servomotor that yaw turns the sitting part 15. Typically, the yaw turn servomotor 40 can serve as a driving source for yaw turning the upper base 21 relative to the lower base 20. In this case, a stator 40*a* of the yaw turn servomotor 40 is fixed to the lower base 20 and a rotor 40*b* of the yaw turn servomotor 40 is fixed to the upper base 21. When the rotor 40*b* of the yaw turn servomotor 40 rotates, the upper base 21 carries out a yaw turn relative to the lower base 20. Alternatively, however, a pinion may be provided in the rotor 40*b* of the yaw turn servomotor 40 and an annular rack may be provided in the upper base 21 so that when the rotor 40*b* of the yaw turn servomotor 40 rotates, the upper base 21 carries out a yaw turn relative to the lower base 20.

The roll turn servomotor 41 is provided in the sitting part 15 and rotates one of the two wheels 24. This allows the roll turn servomotor 41 to move the sitting part 15 along the arched rail 22. That is, the roll turn servomotor 41 can roll turn the sitting part 15.

Figure 7:
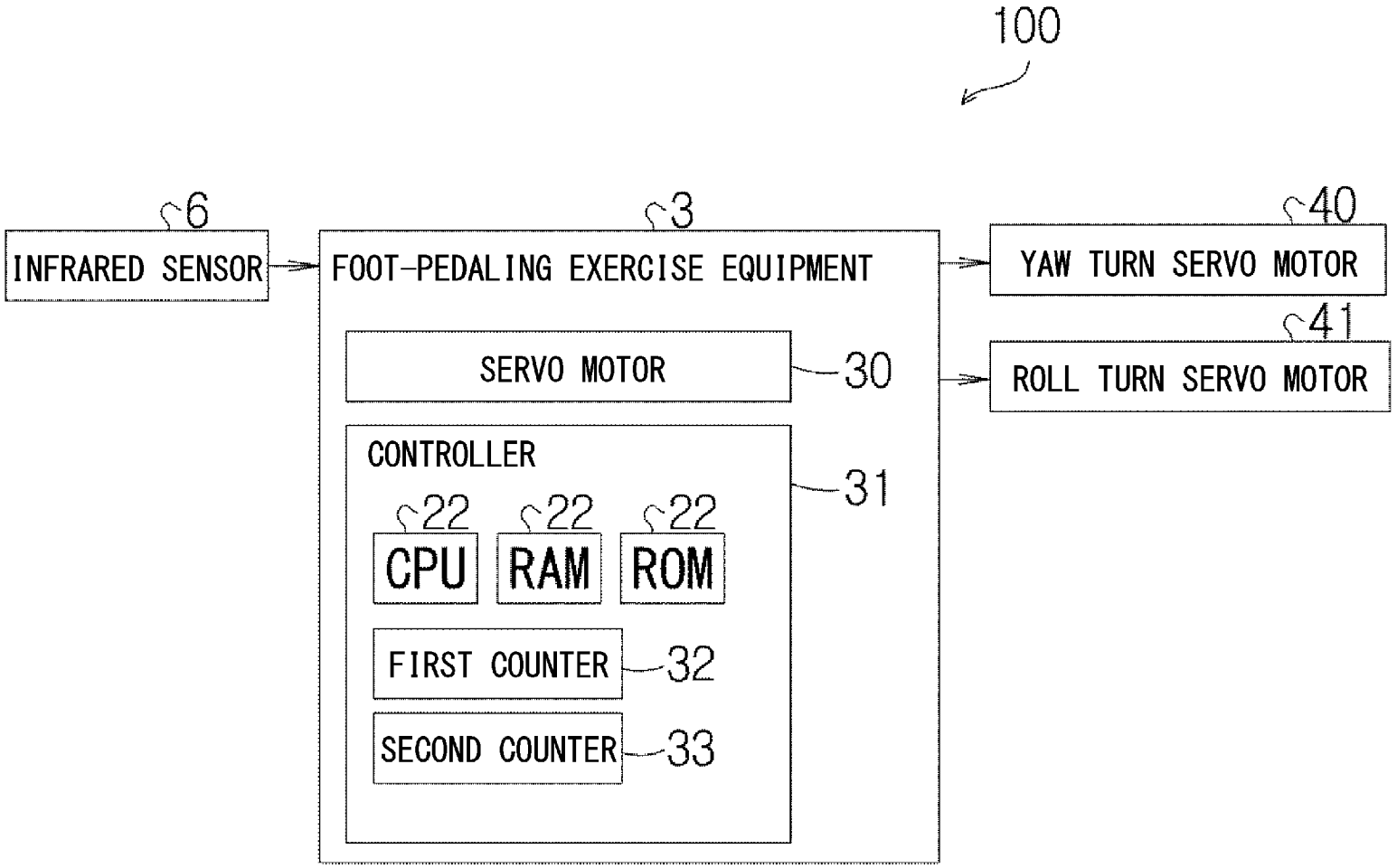
FIG. 7 is a functional block diagram of a foot-pedaling exercise system (second embodiment)
Figure 8:
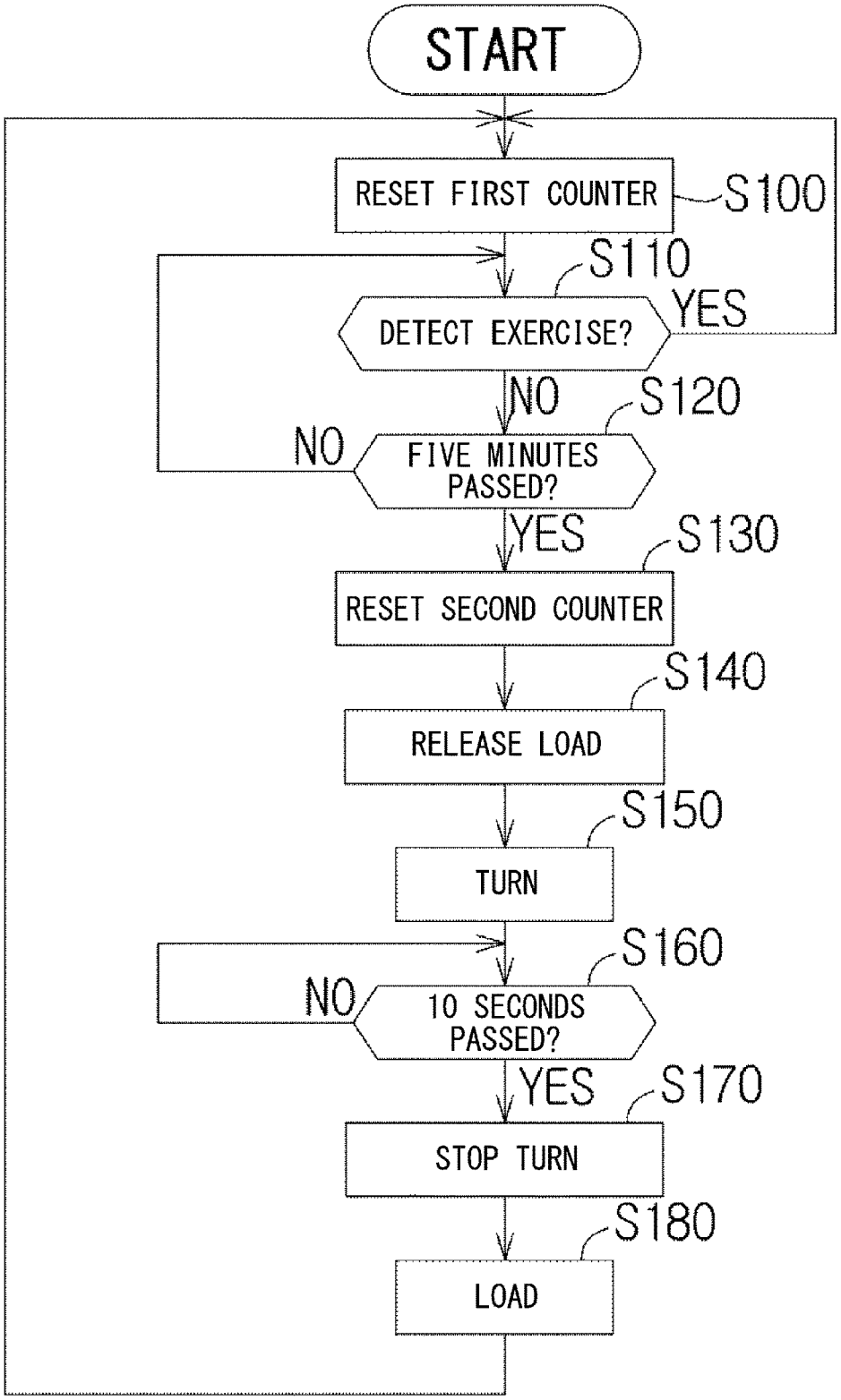
FIG. 8 is a control flow of the foot-pedaling exercise system (second embodiment).

FIG. 7 shows a functional block diagram of the foot-pedaling exercise equipment 3. As shown in FIG. 7, the yaw turn servomotor 40 and the roll turn servomotor 41 are electrically connected to the foot-pedaling exercise equipment 3.

In this embodiment, the foot-pedaling exercise system 100 includes at least a pedal unit 7, an equipment main body 8, a sitting part 15, a yaw turn servomotor and a roll turn servomotor 41, an infrared sensor 6, and a controller 31. The foot-pedaling exercise system 100 may further include a chair 1, a foot-pedaling exercise equipment 3, and an infrared sensor 6.

Next, the operation of the foot-pedaling exercise system 100 will be described with reference to FIG. 8.

In the present embodiment, Steps 150 and 170 are different from those in the first embodiment described above. Accordingly, Steps 150 and 170 will be described below.

S150:

The controller 31 controls the yaw turn servomotor 40 in such a way that the yaw turn servomotor 40 yaw turns the sitting part 15 and controls the roll turn servomotor 41 in such a way that the roll turn servomotor 41 roll turns the sitting part 15.

Specifically, the controller 31 controls the yaw turn servomotor 40 so that the right hip joint moves forward relative to the left hip joint, i.e., the pelvis turns in counterclockwise direction in a plan view, and controls the roll turn servomotor 41 so that the right hip joint becomes lower relative to the left hip joint. This pelvic movement is similar to that when the right leg is swung forward while walking. Therefore, according to the above control, the descending kinetic chain between the pelvis and the lower limb would push the right leg forward relative to the left leg.

The controller 31 then controls the yaw turn servomotor 40 so that the left hip joint moves forward relative to the right hip joint, i.e., the pelvis turns in clockwise direction in a plan view, and controls the roll turn servomotor 41 so that the left hip joint becomes lower relative to the right hip joint. This pelvic movement is similar to that when the left leg is swung forward while walking. Therefore, according to the above control, the descending kinetic chain between the pelvis and the lower limb would push the left leg forward relative to the right leg.

By alternating between the above two controls, one for pushing the right leg forward relative to the left leg, and the other for pushing the left leg forward relative to the right leg, the user U passively starts the foot-pedaling exercise. That is, it is possible to help the user U to start the foot-pedaling exercise. S170:

After a predetermined period of time has passed (S160: YES), the controller 31 stops controlling the yaw turn servomotor 40 and the roll turn servomotor 41 where the yaw turn servomotor 40 and the roll turn servomotor 41 yaw turn and roll turn the sitting part 15. It is the user U who decides whether the pedal unit 7 will rotate after the stop of the control. It can be said that once the user U starts the foot-pedaling exercise even if this exercise is passively started, it is easy for the user U to voluntarily perform the foot-pedaling exercise even after the control of the yaw turn servomotor 40 and the roll turn servomotor 41 stops.

While the second embodiment has been described above, the above embodiment has the following features.

The foot-pedaling exercise system 100 includes the pedal unit 7 including the pair of pedals 12, the equipment main body 8 rotatably supporting the pedal unit 7, the sitting part 15 configured to carry out a yaw turn and a roll turn, the yaw turn servomotor 40 and the roll turn servomotor 41 as the turn actuator that yaw turns and roll turns the sitting part 15, the infrared sensor 6 as the exercise monitoring sensor detecting the performance or the non-performance of the foot-pedaling exercise using the pedal unit 7, and the controller 31. The controller 31 controls the yaw turn servomotor 40 and the roll turn servomotor 41 in such a way that the yaw turn servomotor 40 and the roll turn servomotor 41 yaw turn and roll turn the sitting part 15 when it is determined that the foot-pedaling exercise is not being performed based on the detection result of the infrared sensor 6. According to the above configuration, since the sitting part 15 automatically starts to carry out a yaw turn and a roll turn when the user U does not perform the foot-pedaling exercise, the descending kinetic chain between the pelvis and the lower limb can help the user U to start the foot-pedaling exercise.

If the controller 31 determines, based on the detection result of the infrared sensor 6, that the foot-pedaling exercise has not been performed for five minutes (a third period of time) or longer (S120: YES), the controller 31 controls the yaw turn servomotor 40 and the roll turn servomotor 41 so that the yaw turn servomotor 40 and the roll turn servomotor 41 yaw turn and roll turn the sitting part 15. According to the above configuration, it is possible to secure time for the user to rest without forcing the user U to perform the foot-pedaling exercise at all times.

When a predetermined condition has been satisfied after the yaw turn servomotor 40 and the roll turn servomotor 41 start controlling the yaw turn servomotor 40 and the roll turn servomotor 41 by which the yaw turn servomotor and the roll turn servomotor 41 yaw turn and roll turn the sitting part 15, the controller 31 stops controlling the yaw turn servomotor 40 and the roll turn servomotor 41 by which the yaw turn servomotor 40 and the roll turn servomotor 41 yaw turn and roll turn the sitting part 15. According to the above configuration, it is possible to help the user U to start the foot-pedaling exercise until the predetermined condition is satisfied.

The predetermined condition is in which 10 seconds (a fourth period of time) passes after the yaw turn servomotor 40 and the roll turn servomotor 41 start controlling the yaw turn servomotor 40 and the roll turn servomotor 41 where the yaw turn servomotor 40 and the roll turn servomotor 41 yaw turn and roll turn the sitting part 15. According to the above configuration, it is possible to help the user U to start the foot-pedaling exercise until 10 seconds passes. Note that the fourth period of time is generally set shorter than the third period of time.

In the control of the foot-pedaling exercise system 100, it is determined whether the foot-pedaling exercise is being performed based on the detection result of the infrared sensor 6 (S110). If the foot-pedaling exercise is not being performed (S110: NO), the yaw turn servomotor 40 and the roll turn servomotor 41 are controlled in such a way that the yaw turn servomotor 40 and the roll turn servomotor 41 yaw turn and roll turn the sitting part 15. According to the above method, since the sitting part 15 automatically starts the yaw turn and the roll turn when the user U does not perform the foot-pedaling exercise, the descending kinetic chain between the pelvis and the lower limb can help the user U to start the foot-pedaling exercise.

In this embodiment as well, like in the first embodiment described above, the sitting part 15 is configured to be able to carry out a yaw turn and a roll turn. By using this sitting part 15, the kinematic chain between the lower limb and the trunk can be established during the foot-pedaling exercise, and the trunk muscles such as rectus abdominis, transversus abdominis and erector spinae can be exercised simultaneously while performing the foot-pedaling exercise in a sitting position. Also, by deliberately destabilizing the sitting part 15 as described above, the kinetic chain between the lower limb and the trunk is exerted more effectively. And if the exercise of the trunk muscles is achieved as described above, first, it can be expected that the size of the waist will be reduced. Second, it will strengthen the rectus abdominis, transversus abdominis, and erector spinae muscles, whereby it will become easier to maintain a forward-leaning posture of the pelvis, which will also help eliminate hunchbacks and straight necks. In addition, if the kinematic chain between the lower limb and the trunk can be achieved as described above, the pelvis can be moved intensively, which mainly increases the flexibility of the iliopsoas muscle, and chronic low back pain may be reduced.

Also in this embodiment, the yaw turn and the roll turn of the sitting part by the yaw turn servomotor 40 and the roll turn servomotor 41 stop at a predetermined time (S170), and thereafter, a load is applied to the rotation of the pedal unit 7 by the servomotor 30 (S180). Therefore, when the user U starts to perform the foot-pedaling exercise voluntarily and actively on his/her own volition, the exercise effects represented by the calorie consumption by aerobic exercise and the strengthening of muscles of the lower limb and the trunk will be obtained. However, Step S140 may be omitted and a constant load may be applied to the rotation of the pedal unit 7 by the servomotor 30.

The second embodiment can be changed as follows:

That is, one of the yaw turn servomotor 40 and the roll turn servomotor 41 may be omitted. This is because the aforementioned descending kinetic chain between the pelvis and the lower limb is established by only one of the yaw turn and the roll turn of the pelvis. However, of the yaw turn and the roll turn of the pelvis, the yaw turn is more likely to cause the descending kinetic chain described above. Therefore, if one of the yaw turn servomotor 40 and the roll turn servomotor 41 is omitted, the roll turn servomotor 41 should probably be omitted.

While the infrared sensor 6 has been employed as the exercise monitoring sensor in the above first and second embodiments, a rotation detection sensor detecting the rotation of the pedal unit 7 may instead be employed. In this case, the rotation detection sensor is generally a rotary encoder that detects the rotation of the shaft 10. That is, the rotation detection sensor may be configured to indirectly detect the rotation of the pedal unit 7 by detecting the rotation of the shaft 10.

In addition, the first and second embodiments may be combined with each other. In this case, such a control is required that the turning motion of the sitting part 15 and the rotating motion of the pedal unit 7 are synchronized with each other. However, it could help a user more strongly to start the foot-pedaling exercise when he/she performs the foot-pedaling exercise.

A (The) program can be stored and provided to a computer using any type of non-transitory computer readable media. Non-transitory computer readable media include any type of tangible storage media. Examples of non-transitory computer readable media include magnetic storage media (such as floppy disks, magnetic tapes, hard disk drives, etc.), optical magnetic storage media (e.g. magneto-optical disks), CD-ROM (compact disc read only memory), CD-R (compact disc recordable), CD-R/W (compact disc rewritable), and semiconductor memories (such as mask ROM, PROM (programmable ROM), EPROM (erasable PROM), flash ROM, RAM (random access memory), etc.). The program may be provided to a computer using any type of transitory computer readable media. Examples of transitory computer readable media include electric signals, optical signals, and electromagnetic waves. Transitory computer readable media can provide the program to a computer via a wired communication line (e.g. electric wires, and optical fibers) or a wireless communication line.

From the present disclosure thus described, it will be obvious that the embodiments of the present disclosure may be varied in many ways. Such variations are not to be regarded as a departure from the spirit and scope of the present disclosure, and all such modifications as would be obvious to one skilled in the art are intended for inclusion within the scope of the following claims.

What is claimed is:

1. A foot-pedaling exercise system comprising:

a pedal unit including a pair of pedals;

an equipment main body configured to rotatably support the pedal unit;

a sitting part configured to be able to carry out a yaw turn and/or a roll turn and having a right hip portion and a left hip portion;

a turn actuator configured to yaw turn and/or roll turn the sitting part;

an exercise monitoring sensor configured to detect the performance or the non-performance of a foot-pedaling exercise performed using the pedal unit; and a controller, wherein the controller controls, when it has been determined that the foot-pedaling exercise is not being performed based on the result of the detection in the exercise monitoring sensor, the turn actuator to cause the turn actuator to yaw turn or roll turn the sitting part the controller alternates between a first control and a second control to help a user to start the foot-pedaling exercise, in the first control, the controller controls the turn actuator to drive the sitting part such that the right hip portion moves forward about a yaw axis relative to the left hip portion; and drive the right hip portion in a descending direction about a roll axis such that the right hip portion becomes lower relative to the left hip portion to achieve a pelvic movement of a user that is similar to a pelvic movement when a right leg is swung forward while walking, and in the second control, the controller controls the turn actuator to drive the sitting part such that the left hip portion moves forward about the yaw axis relative to the right hip portion; and drive the left hip portion in a descending direction about the roll axis such that the left hip portion becomes lower relative to the right hip portion to achieve a pelvic movement of a user that is similar to a pelvic movement when a left leg is swung forward while walking.

2. The foot-pedaling exercise system according to claim 1, wherein the controller controls, when it is determined that a state in which the foot-pedaling exercise is not being performed continues for a third period of time or longer based on the result of the detection in the exercise monitoring sensor, the turn actuator to cause the turn actuator to yaw turn or roll turn the sitting part.

3. The foot-pedaling exercise system according to claim 1, wherein the controller stops, when a predetermined condition has been satisfied after the control by which the turn actuator yaw turns or roll turns the sitting part has been started, the control by which the turn actuator yaw turns or roll turns the sitting part.

4. The foot-pedaling exercise system according to claim 3, wherein the predetermined condition is when a fourth period of time passes after the control by which the turn actuator yaw turns or roll turns the sitting part has been started.

5. The foot-pedaling exercise system according to claim 1, wherein the exercise monitoring sensor is a motion detection sensor configured to detect a motion of a lower limb of a user.

6. The foot-pedaling exercise system according to claim 1, wherein the exercise monitoring sensor is a rotation detection sensor configured to detect rotation of the pedal unit.

7. A control method of a foot-pedaling exercise system comprising:

a pedal unit including a pair of pedals;

an equipment main body configured to rotatably support the pedal unit;

a sitting part configured to be able to carry out a yaw turn and/or a roll turn and having a right hip portion and a left hip portion;

a turn actuator configured to yaw turn and/or roll turn the sitting part; and an exercise monitoring sensor configured to detect the performance or the non-performance of a foot-pedaling exercise performed using the pedal unit, the control method comprising:

determining whether the foot-pedaling exercise is being performed based on the result of the detection in the exercise monitoring sensor;

controlling, when it has been determined that the foot-pedaling exercise is not being performed, the turn actuator to cause the turn actuator to yaw turn or roll turn the sitting part; and alternating between a first control and a second control to help a user to start the foot-pedaling exercise, wherein in the first control, the turn actuator is controlled to drive the sitting part such that the right hip portion moves forward about a yaw axis relative to the left hip portion; and drive the right hip portion in a descending direction about a roll axis such that the right hip portion becomes lower relative to the left hip portion to achieve a pelvic movement of a user that is similar to a pelvic movement when a right leg is swung forward while walking, and in the second control, the controller controls the turn actuator to drive the sitting part such that the left hip portion moves forward about the yaw axis relative to the right hip portion; and drive the left hip portion in a descending direction about the roll axis such that the left hip portion becomes lower relative to the right hip portion to achieve a pelvic movement of a user that is similar to a pelvic movement when a left leg is swung forward while walking.

8. A non-transitory computer readable medium storing a control program for causing a computer to execute the control method according to claim 7.

* * * * *